US005761973A

United States Patent [19]

Tung

[11] Patent Number: 5,761,973

[45] Date of Patent: Jun. 9, 1998

[54] DOUBLE-HEADED RATCHET WRENCH ASSEMBLY

[76] Inventor: Yi-ming Tung, No. 23, Tzuchiang 2nd St., Wuchi Chen, Taichung Hsien, Taiwan

[21] Appl. No.: 735,254

[22] Filed: Oct. 22, 1996

[51] Int. Cl.[6] ..... B25B 13/46

[52] U.S. Cl. ..... 81/63.2; 81/177.85

[58] Field of Search ..... 81/177.85, 58.4, 81/60–63.2

[56] References Cited

U.S. PATENT DOCUMENTS 2,803,980 8/1957 Vogel ..... 81/60

4,245,528 1/1981 Hugh et al. ..... 81/177.85

*Primary Examiner*—James G. Smith

*Assistant Examiner*—Benjamin M. Halpern

*Attorney, Agent, or Firm*—Morton J. Rosenberg; David I. Klein; Jun Y. Lee

[57] ABSTRACT

A double-headed wrench assembly includes an upper pressing member with a first driving head and a lower pressing member with a second driving head mounted on upperside and underside of a wrench body respectively. An upper thrust rod has an upper portion slidably mounted in the first driving head and a lower portion with a first enlarged head. A lower thrust rod has a lower portion slidably mounted in the second driving head and an upper portion with a second enlarged head abutting on the first enlarged head. A first biasing member is urged between a lower portion of the upper pressing member and the first enlarged head and a second biasing member is urged between an upper portion of the lower pressing member and the second enlarged head. A first ball is slidably retained in a first detent recess defined in the first driving head and is detachably received in a first cavity defined the upper thrust rod. A second ball is slidably retained in a second socket detent recess defined in the second driving head and is detachably received in a second cavity defined in the lower thrust rod.

9 Claims, 5 Drawing Sheets

DOUBLE-HEADED RATCHET WRENCH ASSEMBLY

FIELD OF THE INVENTION

The present invention relates to a double-headed ratchet wrench assembly.

BACKGROUND OF THE INVENTION

A conventional ratchet wrench comprises a tetragonal driving head securely fitted in a tetragonal recess defined in a tubular sleeve such that the tubular sleeve co-operating with the ratchet wrench can be adapted to rotate a workpiece such as a nut, a bolt and the like. However, the driving head is suitable for the tubular sleeve of a certain dimension only, thereby greatly limiting the availability of the ratchet wrench.

The present invention has arisen to mitigate and/or obviate the disadvantage of the conventional ratchet wrench.

SUMMARY OF THE INVENTION

In accordance with one aspect of the present invention, there is provided a double-headed wrench assembly comprising a wrench body having a chamber defined therein, an upperside with an opening defined therein and communicating with the chamber, and an open underside.

An upper pressing member includes a lower portion movably mounted in the chamber and an upper portion with a first driving head extending beyond the opening. A first passage is vertically defined in the first driving head. A first detent recess is laterally defined in the first driving head and communicates with the first passage.

An upper thrust rod is mounted on the lower portion of the upper pressing member and has an upper portion slidably mounted in the first passage and a lower portion with a first enlarged head. A first cavity is laterally defined in the upper portion of the upper thrust rod and aligns with the first detent recess.

A first ball is slidably retained in the first detent recess and partially and detachably received in the first cavity. A first biasing member is mounted around the upper thrust rod and urged between the lower portion of the upper pressing member and the first enlarged head.

A lower pressing member includes an upper portion movably mounted in the chamber and a lower portion with a second driving head extending beyond the open underside of the wrench body. A second passage is vertically defined in the second driving head. A second detent recess is laterally defined in the second driving head and communicates with the second passage.

A lower thrust rod is mounted on the upper portion of the lower pressing member and has a lower portion slidably mounted in the second passage and an upper portion with a second enlarged head abutting on the first enlarged head. A second cavity is laterally defined in the lower portion of the lower thrust rod and aligns with the second detent recess.

A second ball is slidably retained in the second detent recess and partially and detachably received in the second cavity. A second biasing member is mounted around the lower thrust rod and urged between the upper portion of the lower pressing member and the second enlarged head.

Further features of the present invention will become apparent from a careful reading of the detailed description provided hereinbelow, with appropriate reference to the accompanying drawings.

DETAILED DESCRIPTION OF THE PREFERRED EMBODIMENTS

Figure 1:
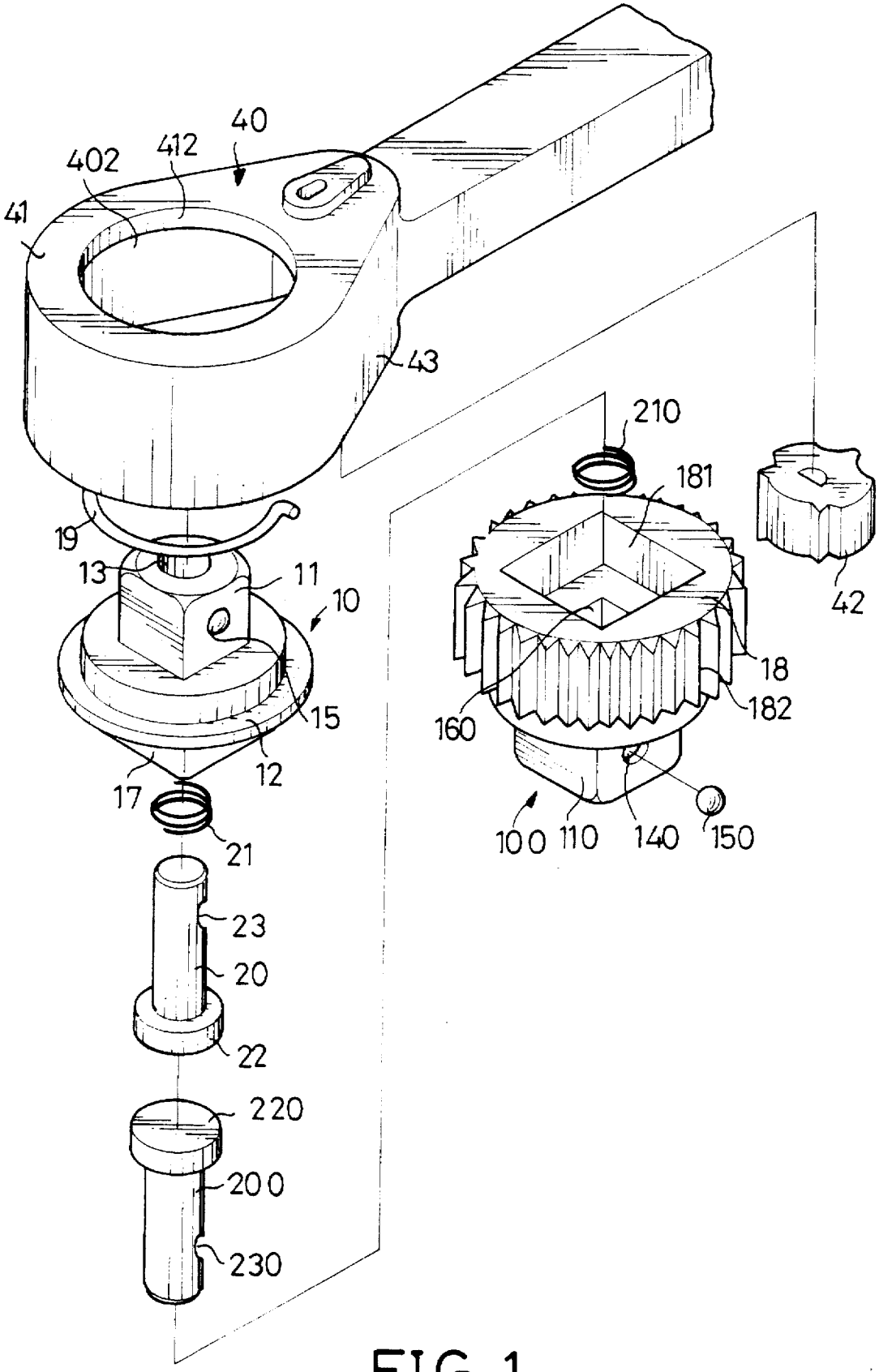
FIG. 1 is an exploded view of a double-headed ratchet wrench in accordance with the present invention.
Figure 2:
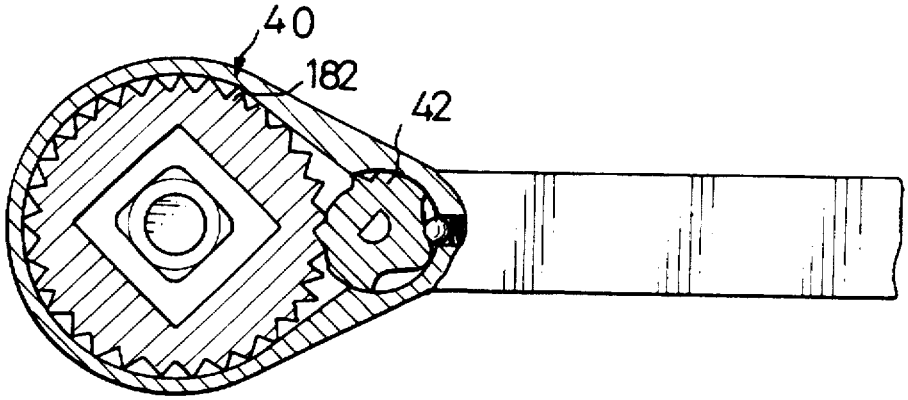
FIG. 2 is a top plan cross-sectional assembly view of FIG. 1.
Figure 3:
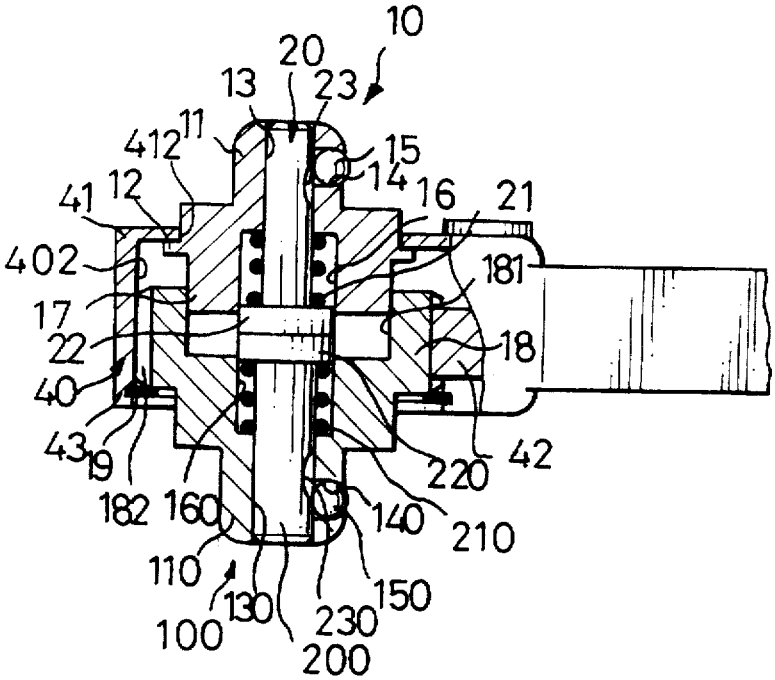
FIG. 3 is a front plan cross-sectional assembly view of FIG. 1.

Referring to the drawings, and initially to FIGS. 1–3, a double-headed ratchet wrench assembly in accordance with the present invention comprises a wrench body (or housing) 40 having a chamber 402 defined therein, an upperside 41 with an opening 412 defined therein and communicating with the chamber 402, and an open underside 43.

An upper pressing member 10 includes a lower portion 17 movably mounted in the chamber 402 and an upper portion with a tetragonal first driving head 11 extending beyond the opening 412.

The upper pressing member 10 has an annular flange 12 received in the chamber 402 and having a dimension greater than that of the opening 412.

A first passage 13 is vertically defined in the first driving head 11, and a first detent recess 14 is laterally defined in the first driving head 11 and communicates with the first passage 13.

An upper thrust rod 20 is mounted on the lower portion 17 of the upper pressing member 10 and has an upper portion slidably mounted in the first passage 13 and a lower portion with a first enlarged head 22.

A first cavity 23 is laterally defined in the upper portion of the upper thrust rod 20 and aligns with the first detent recess 14.

A first ball 15 is slidably retained in the first detent recess 14 and is partially and detachably received in the first cavity 23.

A first biasing member 21 is mounted around the upper thrust rod 20 and is urged between the lower portion 17 of the upper pressing member 10 and the first enlarged head 22.

Preferably, the upper pressing member 10 has a space 16 defined in the lower portion 17 thereof for receiving the first biasing member 21 therein and communicating with the first passage 13.

A lower pressing member 100 includes an upper portion 18 movably mounted in the chamber 402 and a lower portion with a tetragonal second driving head 110 extending beyond the open underside 43 of the wrench body 40.

Preferably, the first driving head 11 has a dimension different from that of the second driving head 110.

The lower pressing member 100 has a recess 181 defined in the upper portion 18 thereof for slidably receiving the lower portion 17 of the upper pressing member 10 therein.

A plurality of teeth 182 are formed on a periphery of the upper portion 18 of the lower pressing member 100 for co-operating with a pawl 42 rotatably mounted in the chamber 402 of the wrench body 40.

A snapping member 19 is fixedly mounted in the open underside 43 of the wrench body 40 and is supported on the lower portion of the lower pressing member 100 for retaining the lower pressing member 100 in the chamber 402.

A second passage 130 is vertically defined in the second driving head 110, and a second detent recess 140 is laterally defined in the second driving head 110 and communicates with the second passage 130.

A lower thrust rod 200 is mounted on the upper portion 18 of the lower pressing member 100 and has a lower portion slidably mounted in the second passage 130 and an upper portion with a second enlarged head 220 abutting on the first enlarged head 22.

A second cavity 230 is laterally defined in the lower portion of the lower thrust rod 200 and aligns with the second detent recess 140.

A second ball 150 is slidably retained in the second detent recess 140 and is partially and detachably received in the second cavity 230.

A second biasing member 210 is mounted around the lower thrust rod 200 and is urged between the upper portion 18 of the lower pressing member 100 and the second enlarged head 220.

The lower pressing member 100 has a space 160 defined in a mediate portion thereof for receiving the second biasing member 210 therein and communicating with the recess 181 and the second passage 130 respectively.

Figure 4:
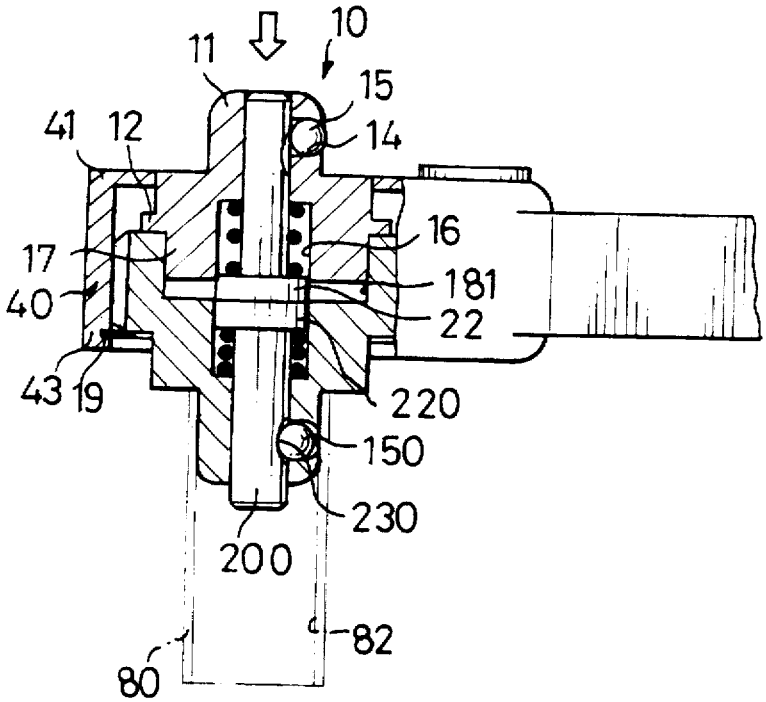
FIGS. 4 and 5 are operational views of FIG. 3.

In operation, referring to FIGS. 3 and 4 with reference to FIGS. 1 and 2, the first and second balls 15 and 150 are initially urged by the upper and lower thrust rods 20 and 200 respectively to partially protrude beyond the first and second detent recesss 14 and 140 as shown in FIG. 3.

Then, the first driving head 11 together with the upper thrust rod 20 can be pressed downwardly, thereby pushing the lower thrust rod 200 downwardly by an abutment between the first and second enlarged heads 22 and 220 to a position as shown in FIG. 4 such that the second cavity 230 aligns with the second detent recess 140, thereby allowing the second ball 150 to be partially received in the second cavity 230 so as to prevent the second ball 150 from protruding beyond the second detent recess 140 such that the second driving head 110 can be easily received in or removed from a channel 82 defined in a first tubular sleeve 80 so as to co-operate with the first tubular sleeve 80.

The upper thrust rod 20 together with the first driving head 11 and the lower thrust rod 200 can then be returned to their original positions as shown in FIG. 3 by means of the returning action of the second biasing members 210.

Figure 5:
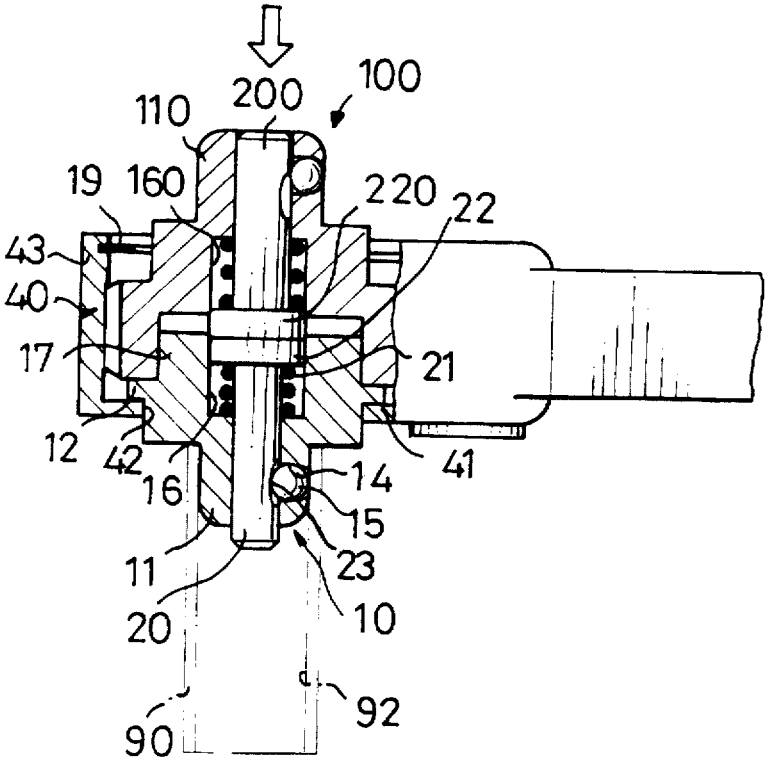

In a similar manner, referring to FIGS. 3 and 5, the wrench body 40 can be inverted and the lower thrust rod 200 together with the second driving head 110 can be pressed downwardly, thereby pushing the upper thrust rod 20 downwardly by an abutment between the first and second enlarged heads 22 and 220 to a position as shown in FIG. 5 such that the first cavity 23 aligns with the first detent recess 14, thereby allowing the first ball 15 to be partially received in the first cavity 23 so as to prevent the first ball 15 from protruding beyond the first detent recess 14 such that the first driving head 11 can be easily received in or removed from a channel 92 defined in a second tubular sleeve 90 with a dimension different from that of the first tubular sleeve 80 so as to co-operate with the second tubular sleeve 90.

The upper thrust rod 20 and the lower thrust rod 200 together with the second driving head 110 can then be returned to their original positions by means of the returning action of the first biasing members 21.

Figure 6:
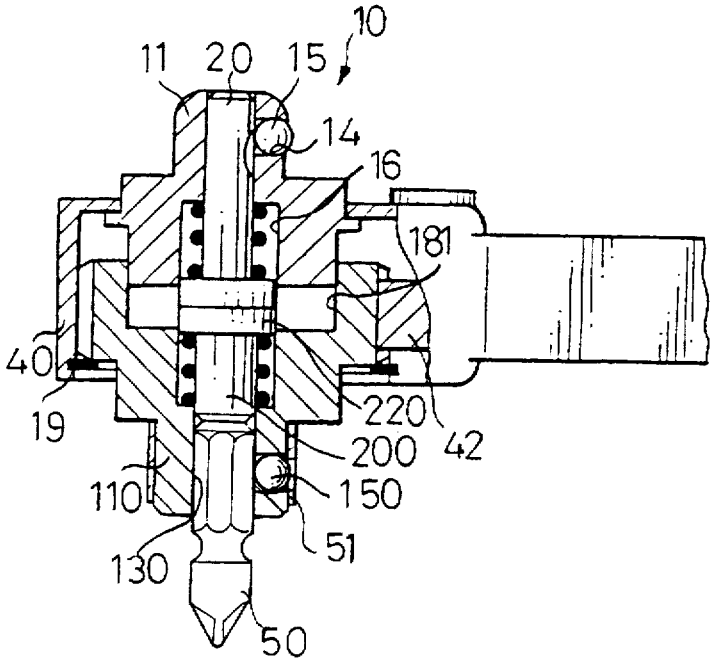
FIG. 6 is a front plan cross-sectional assembly view of a double-headed ratchet wrench according to another embodiment of the present invention.

Referring to FIG. 6, the lower thrust rod 200 is shortened and the second cavity 230 is not defined. A third driving head such as a screwdriver head 50 has an upper portion received in the second passage 130 and retained by the second ball 150 which is urged by a compression ring 51 mounted around the second driving head 110.

It should be clear to those skilled in the art that further embodiments of the present invention may be made without departing from the scope and spirit of the present invention.

What is claimed is:

1. A double-headed wrench assembly comprising:

a wrench body (40) having a chamber (402) defined therein, an upperside (41) with an opening (412) defined therein and communicating with said chamber (402), and an open underside (43);

an upper pressing member (10) including a lower portion (17) movably mounted in said chamber (402) and an upper portion with a first driving head (11) extending beyond said opening (412), a first passage (13) vertically defined in said first driving head (11), a first detent recess (14) laterally defined in said first driving head (11) and communicating with said first passage (13);

an upper thrust rod (20) mounted on the lower portion (17) of said upper pressing member (10) and having an upper portion slidably mounted in said first passage (13) and a lower portion with a first enlarged head (22), a first cavity (23) laterally defined in the upper portion of said upper thrust rod (20) and aligning with said first detent recess (14);

a first ball (15) slidably retained in said first detent recess (14) and partially and detachably received in said first cavity (23);

a first biasing member (21) mounted around said upper thrust rod (20) and urged between the lower portion (17) of said upper pressing member (10) and said first enlarged head (22);

a lower pressing member (100) including an upper portion (18) movably mounted in said chamber (402) and a lower portion with a second driving head (110) extending beyond said open underside (43) of said wrench body (40), said upper portion (18) having a plurality of teeth (182) formed on a periphery thereof for co-operating with a Dawl (42) rotatable mounted in said chamber (402) of said wrench body (40) to provide a ratcheting operation, a second passage (130) vertically defined in said second driving head (110), a second detent recess (140) laterally defined in said second diving head (110) and communicating with said second passage (130);

a lower thrust rod (200) mounted on the upper portion (18) of said lower pressing member (100) and having a lower portion slidably mounted in said second passage (130) and an upper portion with a second enlarged head (220) abutting on said first enlarged head (22), a second cavity (230) laterally defined in the lower portion of said lower thrust rod (200) and aligning with said second detent recess (140);

a second ball (150) slidably retained in said second detent recess (140) and partially and detachably received in said second cavity (230); and a second biasing member (210) mounted around said lower thrust rod (200) and urged between the upper portion (18) of said lower pressing member (100) and said enlarged head (220).

2. The double-headed wrench assembly in accordance with claim 1, wherein said first driving head (11) has a tetragonal cross-section.

3. The double-headed wrench assembly in accordance with claim 1, wherein said second driving head (110) has a tetragonal cross-section.

4. The double-headed wrench assembly in accordance with claim 1, wherein said first driving head (11) has a dimension different from that of said second driving head (110).

5. The double-headed wrench assembly in accordance with claim 1, wherein said upper pressing member (10) has an annular flange (12) received in said chamber (402) and having a dimension greater than that of said opening (412).

6. The double-headed wrench assembly in accordance with claim 1, further comprising a snapping member (19) fixedly mounted in the open underside (43) of said wrench body (40) and supported on the lower portion of said lower pressing member (100) for retaining said lower pressing member (100) in said chamber (402).

7. The double-headed wrench assembly in accordance with claim 1, wherein said upper pressing member (10) has a space (16) defined in the lower portion (17) thereof for receiving said first biasing member (21) therein.

8. The double-headed wrench assembly in accordance with claim 1, wherein said lower pressing member (100) has a recess (181) defined in the upper portion (18) thereof for slidably receiving the lower portion (17) of said upper pressing member (10).

9. The double-headed wrench assembly in accordance with claim 8, wherein said lower pressing member (100) has a space (160) defined in a mediate portion thereof for receiving said second biasing member (210) therein.

* * * * *